US005723804A

United States Patent [19]

Replogle

[11] Patent Number: 5,723,804

[45] Date of Patent: Mar. 3, 1998

[54] ELECTRIC MONOPHONIC/STEREOPHONIC STRINGED RESONATOR INSTRUMENT

[75] Inventor: D. Michael Replogle, Huntington Beach, Calif.

[73] Assignee: Gibson Guitar Corp., Nashville, Tenn.

[21] Appl. No.: 677,764

[22] Filed: Jul. 10, 1996

[51] Int. Cl.[6] ..... G10H 1/08; G10H 1/46; G10H 3/18

[52] U.S. Cl. ..... 84/726; 84/735; 84/741; 84/742; 84/DIG. 27

[58] Field of Search ..... 84/723–728, 731, 84/733–743, DIG. 1, DIG. 27

[56] References Cited

U.S. PATENT DOCUMENTS 4,010,668 3/1977 Plueddemann ..... 84/DIG. 27
4,096,780 6/1978 Dawson ..... 84/DIG. 27
4,196,313 4/1980 Griffiths ..... 84/DIG. 27

*Primary Examiner*—Stanley J. Witkowski
*Attorney, Agent, or Firm*—Dougherty & Hessin, P.C.

[57] ABSTRACT

An electric monophonic/stereophonic stringed resonator instrument includes a body, a resonator assembly mounted on the guitar body, and strings connected to the body. A pickup responsive to string movement and a transducer responsive to resonator assembly action provide respective electric signals representing respective sounds. Independent volume control is provided for each signal. A switch connects the signals either to a common output channel as a blended monophonic output or to respective output channels as a stereophonic output.

11 Claims, 2 Drawing Sheets

ELECTRIC MONOPHONIC/STEREOPHONIC STRINGED RESONATOR INSTRUMENT

BACKGROUND OF THE INVENTION

This invention relates to an electric stringed resonator instrument, such as a resonator guitar, having an electrical pickup system that provides either a single-channel blended monophonic output or a two-channel stereophonic output. Although the present invention pertains to stringed resonator instruments in general, it will be described with specific, but non-limiting, reference to a resonator guitar.

A conventional resonator guitar is an acoustic (i.e., not electrically amplified) instrument that has a resonator assembly mounted in the body of the guitar. The resonator assembly mechanically amplifies the sound produced when a player plays the strings of the guitar. The resonator assembly also adds distinctive timbral characteristics to the resultant sound.

One well-known form of resonator assembly is referred to herein as a DOBRO®-style resonator assembly. This type includes a metal diaphragm in a cavity in the guitar body. A structure referred to as a spider has a central hub with a bridge saddle slot in which the bridge of the guitar is mounted. The spider has radial legs extending outward from the hub. The outer ends of the spider legs engage an outer rim of the diaphragm so that vibrations are transferred from the bridge, through the spider, to the diaphragm. A screw through the center of the spider and the diaphragm connects the two. A slotted metal cover overlies the diaphragm and connects to the guitar body.

Another well-known form of resonator assembly is referred to herein as a NATIONAL-style resonator assembly. This type includes a diaphragm having a central peak above which a bridge mount sits. The bridge mount of a particular implementation includes a circular wooden "biscuit" to which the guitar bridge is connected (such as by being an integral part of the wooden structure). The NATIONAL-style resonator assembly can also include a support structure that includes a ring located beneath the diaphragm within the guitar body and a neck stick extending from the neck of the guitar. In this implementation the diaphragm is mounted on the support ring which is attached to the guitar body and the neck stick.

As with many types of musical instruments, electrical amplification of generated sounds from a resonator guitar is sometimes desired. Since there is both a tonal aspect arising from the strings themselves when they are played and a tonal aspect arising from the resonator assembly, it is desirable to electrically amplify both aspects of a resonator guitar and to selectably provide them for either monophonic or stereophonic reproduction. Thus, there is the need for a resonator guitar (more generally a stringed resonator instrument) which has an electrical pickup system that is responsive to both of these aspects and that can be controlled to output either a combined, selectably blended signal to produce a monophonic sound or separate signals to produce a stereophonic sound.

SUMMARY OF THE INVENTION

The present invention meets the aforementioned needs by providing a novel and improved electric monophonic/stereophonic stringed resonator instrument. An advantage of the present invention is that it is responsive to, and enables the electronic amplification of, the sounds/tones from both the strings and the resonator. Another advantage is that it allows for combined or separate electrical signal output to generate either monophonic or stereophonic sound. The signals from the strings and resonator can each be adjusted to provide a desired blend in the combined monophonic output or to provide separately controlled signals in the stereophonic output.

The electric monophonic/stereophonic stringed resonator instrument of the present invention comprises an instrument body, a resonator assembly mounted on the body, and a plurality of strings connected to the body. The instrument further comprises two generating means for generating respective electric signals in response to a player playing the strings and thereby causing the strings to move and the resonator assembly to vibrate. Also included is output means, connected to the body, for providing two channels through which electric signals are output from the instrument. Means are connected to the output means for selectably allowing either (1) electric signals from both of the generating means to be blended and output through one of the channels of the output means to produce a monophonic output or (2) electric signals from one of the generating means to be output from one of the channels of the output means and electric signals from the other of the generating means to be output from the other of the channels of the output means to produce a stereophonic output.

Therefore, from the foregoing, it is a general object of the present invention to provide a novel and improved electric monophonic/stereophonic stringed resonator instrument. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

Figure 1:
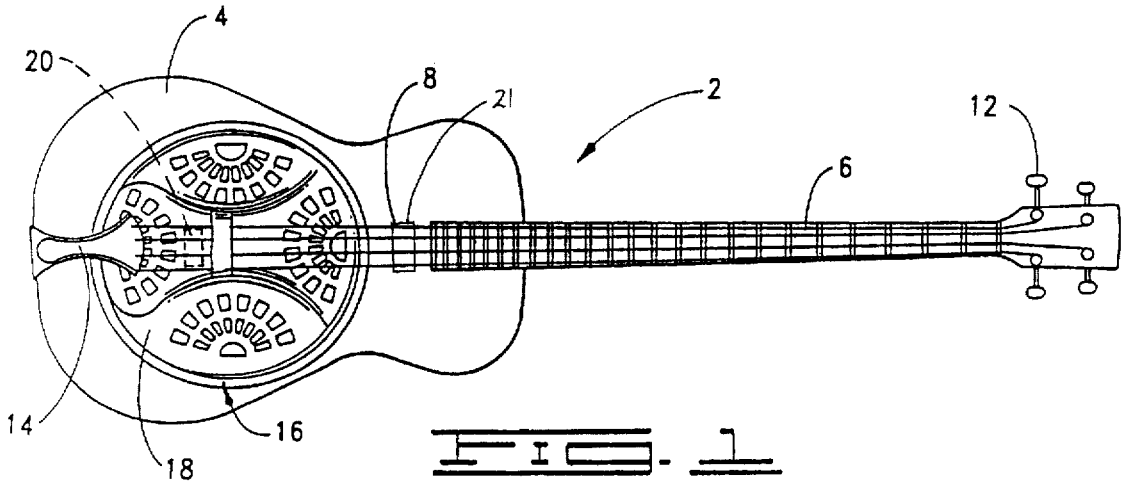
FIG. 1 is an exterior view of a preferred embodiment of an electric resonator guitar of the present invention.

An electric monophonic/stereophonic resonator guitar 2 constructed in accordance with the present invention is shown in FIG. 1. A resonator bass guitar is specifically illustrated; however, the present invention is applicable to any stringed resonator instrument.

The guitar 2 includes a body 4 to which a fretted neck 6 is connected. Strings 8 are strung across supporting bridge 10 (FIGS. 2 and 3, for example) between tuning pegs 12 and tailpiece 14. The tuning pegs 12 are connected to the neck 6, and the tailpiece 14 is connected to the body 4. These components and their construction can be conventional for resonator guitars.

The body 4, which can be of either the acoustic type or solid body type, has a cavity which is at least of sufficient size to receive a resonator assembly 16 in a conventional manner for resonator guitars. The resonator assembly 16 includes a metal (e.g., chrome plated brass) cover 18 shown in FIG. 1.

Figure 2:
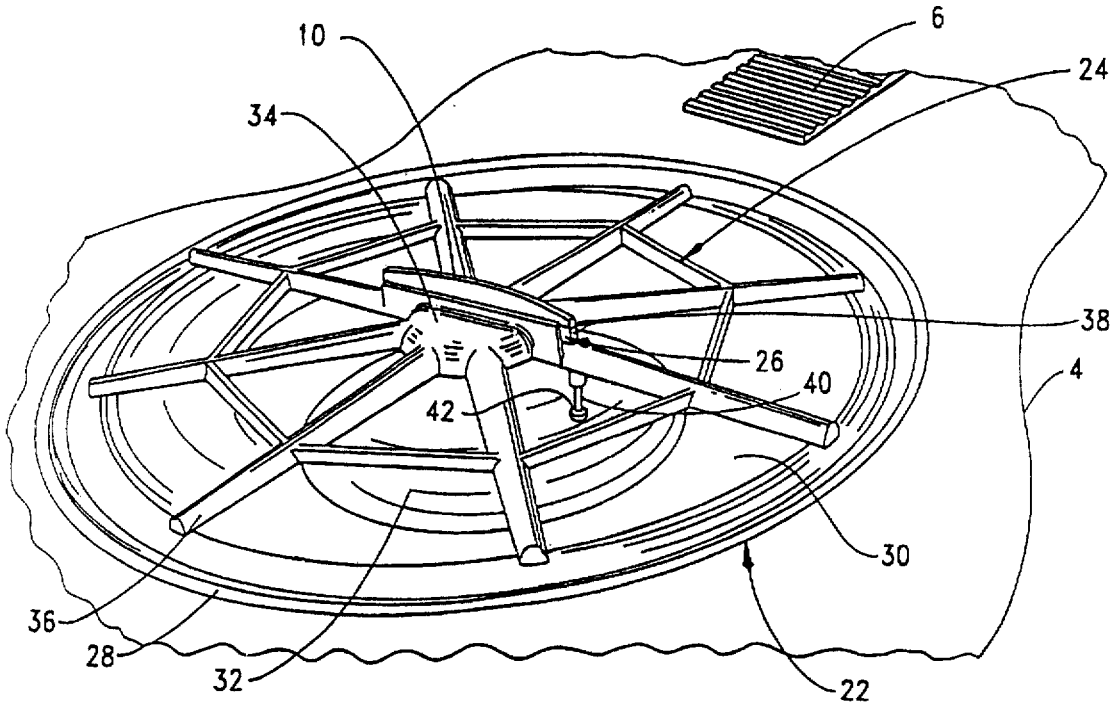
FIG. 2 is a perspective view of a spider and diaphragm of a DOBRO®-style resonator assembly.
Figure 3:
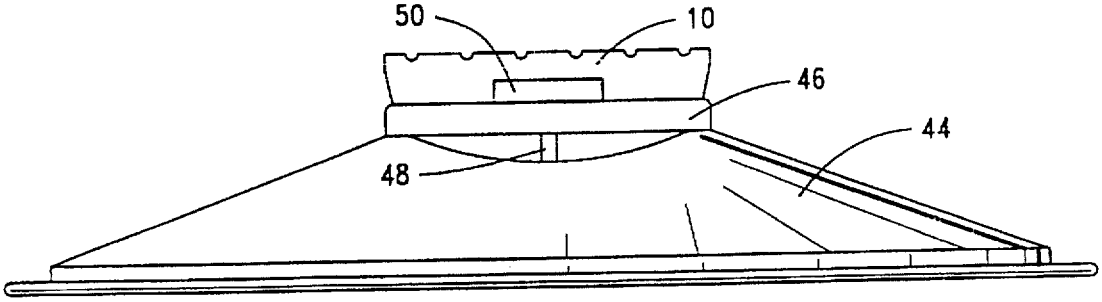
FIG. 3 is an elevational view of a biscuit bridge and diaphragm of a NATIONAL-style resonator assembly.

In addition to the cover 18, a conventional resonator assembly 16 includes a metal diaphragm and a bridge mount. "Bridge mount" is the term used herein for the resonator assembly structure to which the bridge 10 connects and which connects to the diaphragm so that string vibrations communicated through the bridge 10 are conducted to the diaphragm. The resonator assembly can also include a support structure. One particular implementation of the resonator assembly 16, referred to as a DOBRO®-style resonator assembly, is illustrated in FIG. 2. Another particular implementation, referred to as a NATIONAL-style resonator assembly, is illustrated in FIG. 3.

Referring to FIG. 2, a DOBRO®-style resonator assembly includes, in addition to the metal cover 18 shown in FIG. 1, a metal diaphragm 22, a spider 24 connected to the diaphragm 22, and a bridge saddle slot 26 defined on the spider 24. These are of conventional design for a resonator guitar. The diaphragm 22, made of a suitable metal such as aluminum, is circular and has an outer support rim 28 from which a sloping wall 30 extends downwardly and then upwardly to define a central cone 32. The spider 24, made of a suitable metal such as aluminum, has a central hub 34 from which a plurality of legs 36 radially extend. The outer ends of the legs 36 rest on the outer rim 28 of the diaphragm 22, thereby positioning the hub 34 directly above the apex of the cone 32 as shown in FIG. 2. The bridge saddle slot 26 is integrally formed with the hub 34 of the spider 24. An axially disposed bolt and nut (not shown) typically hold these components together in known manner.

Also shown in FIG. 2 is a transducer 38. This signal generating means is disposed in the bridge saddle slot 26 beneath the bridge 10. The preferred embodiment of the transducer 38 is a Fishman or L. R. Baggs brand. This is preferred because of their true sound reproduction characteristics.

Two-wire cable 40 extends from the body of the transducer 38. The cable 40 is shown extending through a hole 42 cut in the diaphragm 22. Alternatively, and preferably, the cable can extend along a leg 36 of the spider 24 and beyond the rim of the diaphragm 22 and then down through a hole cut in the body 4 of the guitar 2.

In FIG. 3, the NATIONAL-style resonator assembly includes a diaphragm 44 on which the bridge 10 is mounted. This mounting is by means of a circular wooden "biscuit" 46 with which the bridge 10 is integrally formed. A screw 48 secures the "biscuit bridge" to the apex of the conical diaphragm 44. The diaphragm 44 is made of metal, such as aluminum.

In the FIG. 3 embodiment, a transducer is connected, such as by adhesive caulk, to the biscuit bridge mount 46 at location 50. The transducer is shown on top of the biscuit bridge mount 46, but it can also be located on the underside of the mount 46. The transducer for either of these locations is preferably of the type obtained from McIntyre Guitar Co.

The resonator assembly-responsive transducer referred to above forms another part of the present invention. The transducer provides one form of a means for generating electric signals representing at least a portion of resophonic sounds produced by the resonator assembly 16 in response to a player playing the strings 8. The generated electric signals are for electrical amplification so that the resophonic sound mechanically created and amplified by the resonator guitar 2 can be electrically broadcast through loudspeakers or otherwise electrically processed.

A preferred embodiment of this signal generating means is an electroacoustic transducer that receives acoustic signals (sound) generated by the resonator assembly and that converts the received signals into corresponding analog electric signals. One type of electroacoustic transducer is a microphone, specific examples of which are the Shure SM98 and the "COUNTRYMAN HYPERCARDIOD" model. These are distinguishable from other types of microphones that have been used with resonator guitars in that these preferred microphones are small and easily mounted into the small space confines of the resonator assembly itself.

Another preferred embodiment of the signal generating means is an electromechanical transducer that receives vibrations from the resonator assembly and that converts the received vibrations into corresponding analog electric signals. One type of electromechanical transducer is a piezoelectric pickup, specific examples of which are manufactured by Fishman Transducers and L. R. Baggs. Non-limiting examples of other suitable transducers include the flattop guitar transducer manufactured by McIntyre Guitar Co. and the "SHADOW" brand transducers.

FIG. 1 illustrates a location where the resonator assembly-responsive transducer can be directly connected to the interior surface of the metal cover 18 of the resonator assembly 16. This location is designated by the reference numeral 20. This location is underneath the strings where they pass from the bridge to the tailpiece so that more string volume is picked up. An encased transducer can be attached to the surface of the cover 18. If a microphone is used, it can be directly connected via a mounting bracket attached to the interior surface of the cover 18. A McIntyre type of transducer is preferred for direct connection to the cover 18 because of improved gain and tone reproduction of the unit.

The transducer of the present invention can be directly connected to any location of the resonator assembly 16 (specific examples have been given above with reference to FIGS. 2 and 3), regardless of the particular implementation of the resonator assembly. The most preferred ones are under the junction of the rear legs of the spider of the DOBRO®-style resonator assembly or directly to the underside of the diaphragm of the NATIONAL-style resonator assembly or under the biscuit of the NATIONAL-style resonator assembly; however, neither these nor any of the other illustrated locations limit the broader aspects of the present invention. Other non-limiting examples are shown in U.S. patent application Ser. No. 08/455.568 filed May 31, 1995, which is incorporated herein by reference for all purposes.

The present invention further comprises another means for generating electric signals in response to playing the guitar 2, this means being directly responsive to movement of one or more of the strings 8. This is preferably implemented by a conventional electromagnetic pickup having a conventional construction including one or more magnetic or magnetized pole pieces around which one or more coils of wire are wound. Non-limiting examples of such a pickup include Lace brand electromagnetic single-coil or stacked humbucking pickups. A preferred location 21 for such a pickup is shown in FIG. 1. This location is beneath the strings 8 so that the strings 8 pass through the magnetic field of the pickup. The pickup generates an electrical signal in response to movement of the strings 8 in the magnetic field as is well known in the art.

Figure 4:
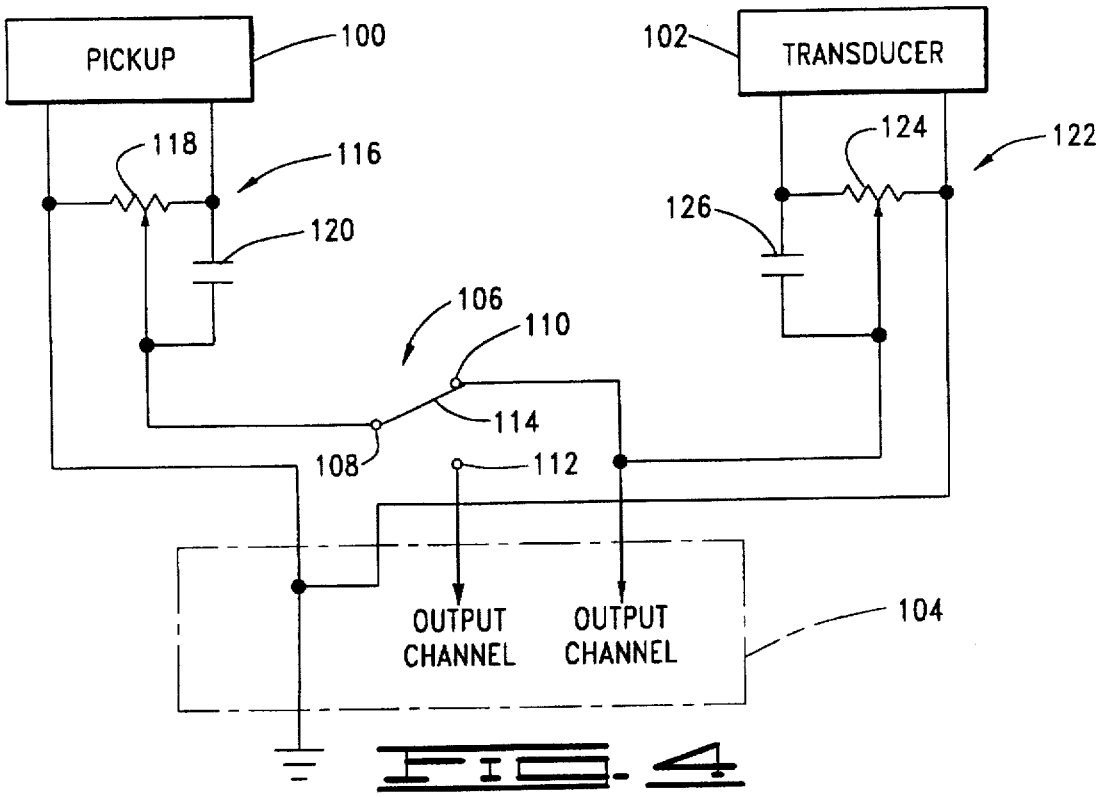
FIG. 4 is a schematic circuit diagram of one preferred embodiment of a pickup system of the present invention.
Figure 5:
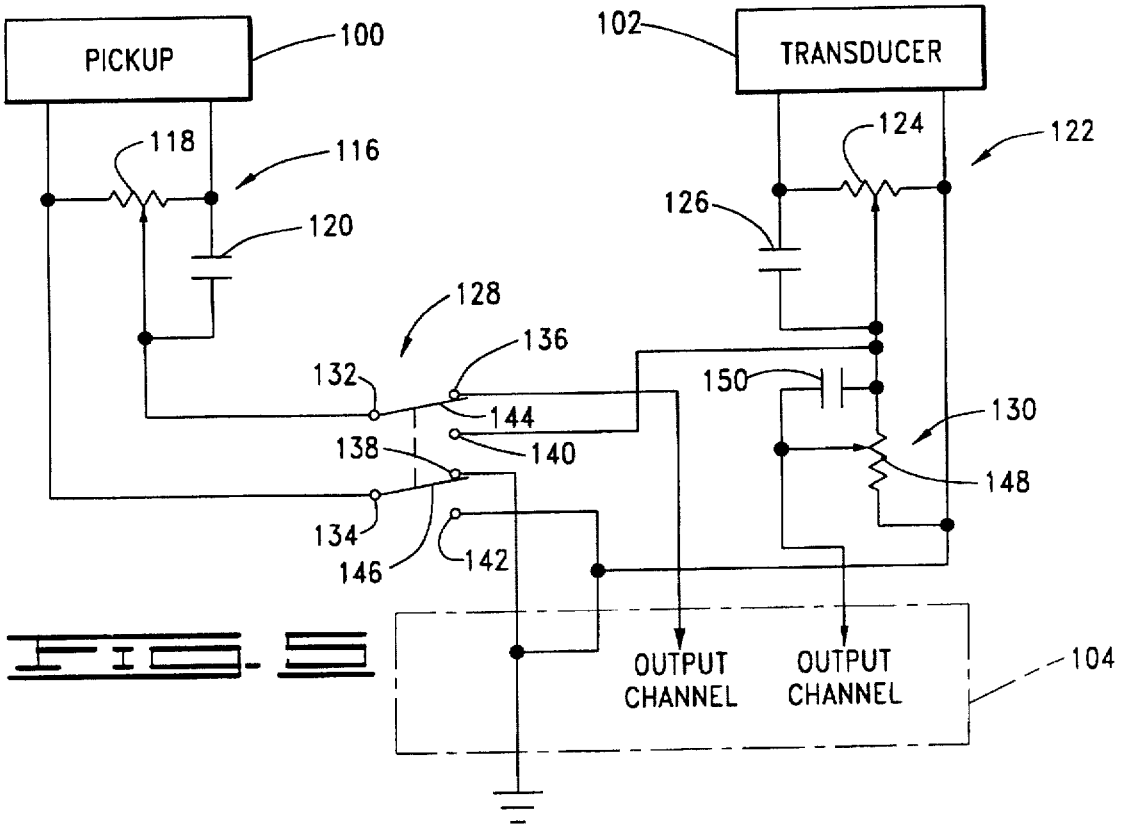
FIG. 5 is a schematic circuit diagram of another preferred embodiment of a pickup system of the present invention.

The string-responsive pickup and the resonator-responsive transducer referred to above are identified in FIGS. 4 and 5 by the reference numbers 100, 102, respectively. These are part of the electrical pickup system of the present invention, one embodiment of which pickup system is shown in FIG. 4. The pickup 100 and the transducer 102 define two means for generating respective electric signals in response to a player playing one or more of the strings 8 and thereby causing the string(s) to move and the resonator assembly to vibrate.

The pickup system shown in FIG. 4 also includes output means for providing two channels through which electric signals are output from the guitar 2. This output connector is typically implemented by an output connector 104, such as a jack which has one terminal that engages the tip of a plug and which has another terminal that engages the sleeve of the plug used in conventional cables connecting the guitar to a preamplifier or amplifier in known manner. The jack 104 of the FIG. 4 implementation also has a ground terminal as shown.

Forming another part of the pickup system of the present invention is means for selectably allowing the outputs from the pickup 100 and the transducer 102 to be provided either in a controllable blend together through one output channel as a monophonic signal or each separately through their respective output channel to provide a stereophonic output. In the FIG. 4 embodiment, this means includes a switch 106 which can be implemented either electrically or mechanically. A mechanical implementation is illustrated in FIG. 4 as including a pole 108 and terminals 110, 112. This defines a single-pole double-throw switch having two switch states. The pole 108 is connected to the pickup 100. The terminal 110 is connected to the transducer 102 and one of the output channels of the output connector 104. The terminal 112 is connected to the other output channel of the output connector 104. A switch element 114 provides means for selectably connecting the pole 108 to one of the terminals 110, 112.

The connection of the pole 108 to the pickup 100 is through a volume control circuit 116 including a potentiometer 118 having its fixed ends connected across the pickup leads and having its wiper connected to a capacitor 120 and the pole 108. The other end of the capacitor 120 is connected to one end of the potentiometer 118 and the "hot" lead of the pickup 100. The other end of the potentiometer 118 and the other lead of the pickup 100 are connected to electrical ground with the connector 104 as shown in FIG. 4.

The terminal 110 is connected to the transducer 102 through a volume control circuit 122 comprising a potentiometer 124 and a capacitor 126 connected to the transducer 102 in a manner similar to the circuit 116 connection to the pickup 100 as shown in FIG. 4.

In a specific implementation, the potentiometers 118, 124 are 250 kiloohms and the capacitors 120, 126 are each 0.001 microfarads.

Respective channel volume control as provided by the volume control circuits 116, 122 is desired to allow for the distinctive signals from the pickup 100 and the transducer 102 to be blended together in a selectable manner in monophonic mode and to give separate channel control in stereophonic mode. That is, the potentiometer 118 can be operated by a player of the guitar from a guitar-body mounted control knob attached to the potentiometer 118 in known manner and the potentiometer 124 can be operated by the player from a separate, guitar-body mounted control knob attached to the potentiometer 124 in known manner, thereby giving the player separate control of the signals from the pickup 100 and the transducer 102 (of course, someone other than a "player" can manipulate the potentiometers, and other control techniques, e.g., remote, can be implemented and still be within the scope of the present invention). Respective channel volume control also gives control for eliminating potential feedback problems, particularly with respect to more sensitive or feedback prone transducers.

In the switch state shown in FIG. 4, wherein the switch element 114 connects the pole 108 and the terminal 110, both of the volume control circuits 116, 122 are connected to the same output channel of the output connector 104 to provide a monophonic output of the pickup and transducer. The nature of this monophonic output is defined by the blend of the pickup and transducer signals as controlled via the potentiometers 118, 124. In the other switch state, wherein the switch element 114 connects the pole 108 with the terminal 112, the volume control circuit 116 is connected to the other output channel of the output connector 104 and the volume control circuit 122 is connected to the first-mentioned output channel of the output connector 104 to provide the stereophonic output of the pickup and transducer. The two channels of the stereophonic output are respectively controlled via the potentiometers 118, 124.

Referring to FIG. 5, another embodiment of the pickup system of the present invention will be described. This embodiment includes like elements to those shown in FIG. 4 as indicated by the use of the same reference numerals. Different aspects of the FIG. 5 embodiment include a different type of switch 128 and a third volume control circuit, which is identified by the reference numeral 130; however, a monophonic output of a controllable blend or a stereophonic output of separate controllable channels is still selectable.

The switch 128 is a double-pole double-throw switch having a pair of poles 132, 134. Associated with the poles 132, 134 are two pairs of terminals. One pair includes terminals 136, 138, and the other pair includes terminals 140, 142. Ganged switch elements 144, 146 selectably connect the poles with one of the pairs of terminals.

The pole 132 is connected to the volume control circuit 116 of FIG. 5. Depending on the setting of the switch element 144, the pole 132 also connects to either the terminal 136 or the terminal 140. The terminal 136 is connected to one output channel of the output connector 104 of FIG. 5, and the terminal 140 is connected to the wiper of the potentiometer 124 of the volume control circuit 122 of FIG. 5. The terminal 140 also connects to one end of a potentiometer 148 and a capacitor 150 of the volume control circuit 130 which functions as a monophonic master control circuit for the resultant blended monophonic output provided through the wiper of the potentiometer 148 (the nature of the blend itself is still separately controlled via the circuits 116, 122). This wiper of the potentiometer 148 is connected to the other output channel of the output connector 104 of FIG. 5.

The pole 134 connects to the ground lead of the pickup 100. The pole 134 also connects to either the terminal 138 or the terminal 142 depending upon the setting of the switch element 146. The terminal 138 connects to system ground which is also connected to the output connector 104. The terminal 142 connects to the ground lead of the transducer 102 of FIG. 5.

With the switch state shown in FIG. 5, stereophonic sound is provided since (1) the electrical signal provided from the pickup 100 is communicated to its independent output channel of the output connector 104 through the terminal 136 and (2) the output from the transducer 102 is provided to its independent output channel of the output connector 104 through both the volume control circuit 122 and the volume control circuit 130.

In the other switch position with the switch element 144 connecting the pole 132 and the terminal 140 and the switch element 146 connecting the pole 134 and the terminal 142, the output from the pickup 100 is blended with the output from the transducer 102 at the junction with the potentiometers 124, 148. This combined output is adjusted as desired through the master control circuit 130 and fed through the output channel of the output connector 104 for rendering a monophonic sound reproduction.

In either position of the switch element 146, the ground leads of the pickup 100 and the transducer 102 are connected with the system ground as is apparent from FIG. 5.

With the present invention, one obtains a stringed resonator instrument which has both string and resonator produced sounds that can be separately controlled yet output either in a desired monophonic blend or via separate stereophonic channels. Separate control allows for distinctive tone manipulation with respect to both the string and the resonator responsive sounds, and it also allows for feedback reduction or elimination. The separate control is implemented for convenient control by the musician (or another) so that changes can be effected easily and quickly.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. An electric monophonic/stereophonic stringed resonator instrument, comprising:

an instrument body;

a resonator assembly mounted on said body;

a plurality of strings connected to said body;

two generating means for generating respective electric signals in response to a player playing said strings and thereby causing said strings to move and said resonator assembly to vibrate;

output means, connected to said body, for providing two channels through which electric signals are output from said instrument; and means, connected to said output means, for selectably allowing either (1) electric signals from both of said generating means to be blended and output through one of the channels of said output means to produce a monophonic output or (2) electric signals from one of said generating means to be output from one of the channels of said output means and electric signals from the other of said generating means to be output from the other of the channels of said output means to produce a stereophonic output.

2. An electric monophonic/stereophonic stringed resonator instrument as defined in claim 1, wherein said two generating means includes:

a pickup responsive to said strings; and a transducer responsive to said resonator assembly.

3. An electric monophonic/stereophonic stringed resonator instrument as defined in claim 2, wherein said output means includes a two-channel output jack.

4. An electric monophonic/stereophonic stringed resonator instrument as defined in claim 3, wherein said means for selectably allowing includes a mechanical switch connected to said two generating means and said output jack.

5. An electric monophonic/stereophonic stringed resonator instrument as defined in claim 4, wherein said mechanical switch is connected to said two generating means through respective volume control circuits.

6. An electric monophonic/stereophonic stringed resonator instrument as defined in claim 1, further comprising:

a first volume control circuit connected to one of said two generating means; and a second volume control circuit connected to the other of said two generating means.

7. An electric monophonic/stereophonic stringed resonator instrument as defined in claim 6, further comprising a third volume control circuit connected between said second volume control circuit means and said one of said channels of said output means.

8. An electric monophonic/stereophonic resonator guitar, comprising:

a guitar body;

a resonator assembly mounted on said guitar body;

a plurality of strings connected to said guitar body;

an electromagnetic pickup connected to said guitar body so that said pickup is responsive to movement of said strings;

a transducer connected to said resonator assembly;

a first volume control circuit, connected to said pickup;

a second volume control circuit, connected to said transducer;

an output connector providing two output channels for electric signals; and a switch having at least two switch states, said switch connected to said first and second volume control circuits such that (1) in one switch state both said first and second volume control circuits are connected to the same output channel of said output connector to provide a monophonic output comprising a controllable blend of signals from said pickup and transducer, and (2) in another switch state said first volume control circuit is connected to one of the two output channels of said output connector and said second volume control circuit is connected to the other of the two output channels of said output connector to provide a stereophonic output comprising separately controllable signals from said pickup and transducer, wherein the blend of signals of the monophonic output and the separate signals of the stereophonic output are controllable with said first and second volume control circuits.

9. An electric monophonic/stereophonic resonator guitar as defined in claim 8, wherein said switch includes:

a pole connected to said first volume control circuit;

a first terminal connected to said second volume control circuit and to said other of the two output channels of said output connector;

a second terminal connected to said one of the two output channels of said output connector; and means for selectably connecting said pole to one of said first and second terminals.

10. An electric monophonic/stereophonic resonator guitar as defined in claim 8, wherein said switch includes:

a pair of poles, one of said poles connected to said first volume control circuit, and the other of said poles connected to an electrical ground junction of said first volume control circuit;

a first pair of terminals, one of said first pair connected to said second volume control circuit and to said other of the two output channels of said output connector, and the other of said first pair connected to an electrical ground junction of said second volume control circuit;

a second pair of terminals, one of said second pair connected to said one of the two output channels of said output connector, and the other of said second pair connected to the electrical ground; and means for selectably connecting said pair of poles to one of said first and second pairs of terminals.

11. An electric monophonic/stereophonic resonator guitar as defined in claim 10, further comprising a master volume control circuit connecting said second volume control circuit and said one of said first pair of terminals to said other of the two output channels of said output connector.

* * * * *